US007549957B2

(12) United States Patent
Hruschka et al.

(10) Patent No.: US 7,549,957 B2
(45) Date of Patent: Jun. 23, 2009

(54) SCREW-TYPE SOLID BOWL CENTRIFUGE

(75) Inventors: Steffen Hruschka, Oelde (DE); Roger Hulsmann, Oelde (DE)

(73) Assignee: Westfalia Separator GmnH, Oelde (DE)

( * ) Notice: Subject to any disclaimer, the term of this patent is extended or adjusted under 35 U.S.C. 154(b) by 0 days.

(21) Appl. No.: 12/158,634

(22) PCT Filed: Dec. 14, 2006

(86) PCT No.: PCT/EP2006/069718

§ 371 (c)(1),
(2), (4) Date: Jun. 20, 2008

(87) PCT Pub. No.: WO2007/074076

PCT Pub. Date: Jul. 5, 2007

(65) Prior Publication Data

US 2008/0312060 A1 Dec. 18, 2008

(30) Foreign Application Priority Data

Dec. 22, 2005 (DE) ..... 10 2005 061 461

(51) Int. Cl.
*B04B 1/20* (2006.01)

(52) U.S. Cl. ..... 494/54; 494/901

(58) Field of Classification Search ..... 494/50–55, 494/901; 366/319, 322; 198/661, 662, 664, 198/676; 210/380.1, 380.3
See application file for complete search history.

(56) References Cited

U.S. PATENT DOCUMENTS 4,731,182 A * 3/1988 High ..... 210/374
5,653,673 A * 8/1997 Desai et al. ..... 494/27
6,004,255 A * 12/1999 Madsen ..... 494/54
6,908,423 B2 * 6/2005 Hruschka et al. ..... 494/37
2007/0049480 A1 * 3/2007 Stroucken et al. ..... 494/53
2008/0312060 A1 * 12/2008 Hruschka et al. ..... 494/53

FOREIGN PATENT DOCUMENTS

| | | | | |
|---|---|---|---|---|
| DE | 41 32 693 | A1 | | 4/1993 |
| EP | 0 557 758 | B1 | | 9/1993 |
| EP | 574364 | A1 | * | 12/1993 |
| EP | 0 845 296 | A1 | | 6/1998 |
| EP | 1 364 717 | A2 | | 11/2003 |
| EP | 1364717 | A2 | * | 11/2003 |
| JP | 57194061 | A | * | 11/1982 |
| JP | 61-82855 | | | 4/1986 |
| JP | 02160063 | A | * | 6/1990 |
| WO | 97/23295 | A1 | | 7/1997 |
| WO | 02/38278 | A1 | | 3/2002 |
| WO | 2005/084814 | A1 | | 9/2005 |
| WO | WO 2007074076 | A1 | * | 7/2007 |

* cited by examiner

*Primary Examiner*—Charles E Cooley
(74) *Attorney, Agent, or Firm*—Barnes & Thornburg LLP

(57) ABSTRACT

A screw-type solid-bowl centrifuge including a rotatable drum having a tapering portion and a cylindrical portion. The rotatable screw includes a screw body, at least one main screw blade surrounding the screw body and forming a plurality of screw flights. The plurality of screw flights forms a conveying path configured to transport a material to be processed in the centrifuge. Two blade segments are arranged in the conveying path in portions of the plurality of screw flights. The at least one main screw blade is provided in a region of the blade segments that includes clearances configured to allow a throughflow of the material to be processed to flow between adjacent screw flights.

15 Claims, 2 Drawing Sheets

SCREW-TYPE SOLID BOWL CENTRIFUGE

BACKGROUND AND SUMMARY

The present disclosure relates to a screw-type solid-bowl centrifuge including a rotatable drum having a tapering portion and a cylindrical portion. The rotatable screw includes a screw body, at least one main screw blade surrounding the screw body and forming a plurality of screw flights. The plurality of screw flights forms a conveying path configured to transport a material to be processed in the centrifuge. Two blade segments are arranged in the conveying path in portions of the plurality of screw flights. The at least one main screw blade is provided in a region of the blade segments that includes clearances configured to allow a throughflow of the material to be processed to flow between adjacent screw flights.

Decanter screws are known from the prior art, in which clearances are provided in the screw blade, as, for example, from DE 41 32 693 A1. Moreover, it is also known to form screw flights resembling blade segments, as, for example, from WO 97/23295. These blade segments, however, sometimes extend well into the conical portion, this being a disadvantage. Furthermore, they are distributed on the circumference of the screw body in the entire region of the latter, and this has likewise proved to be somewhat of a disadvantage. Moreover, additional blade segments are not, for example, set up in the conveying path between the screw flights, but, instead, the blade segments themselves form the screw flights. By the two references just mentioned above, a sufficiently high efficiency in the extraction of olive oil, for example, cannot be achieved.

One method appropriate in the extraction of olive oil is known from EP 0 557 758. In this method, two-phase separation is carried out, in which the oil is separated directly from a solid/water mixture.

The efficiency of known methods is improved, for example, by WO 02/38 278 A1, which discloses, in addition to generic features, that additional blade segments are arranged in the conveying path in portions between adjacent screw flights. The screw blade is provided in the region of the screw blade segments with clearances which are formed in such a way that a throughflow of the centrifuged stock between adjacent screw flights is possible.

Other prior art includes WO97/22411 A1, WO 2005/084814 A1, DE 699 20 500 T2 and EP 0 845 296 A.

Proceeding from WO 02/38 278 A1, the present disclosure relates to a decanter screw to improve a processing of pulps, for example, oil extraction, by a decanter having a screw as disclosed herein.

Thus, the present disclosure relates to a screw-type solid-bowl centrifuge comprising a rotatable drum including a tapering portion and a cylindrical portion. The rotatable screw includes a screw body, at least one main screw blade surrounding the screw body and forming a plurality of screw flights. The plurality of screw flights forms a conveying path configured to transport a material to be processed in the centrifuge. Two blade segments are arranged in the conveying path in portions of the plurality of screw flights. The at least one main screw blade is provided in a region of the blade segments that includes clearances configured to allow a throughflow of the material to be processed to flow between adjacent screw flights of the plurality of screw flights. The two blade segments are further arranged in only a first and a second of the plurality of screw flights. A first of the two blade segments in the first screw flight lies nearer the tapering portion than the second screw flight. The first of the two blade segments is configured to be turned forward in relation to the at least one main screw blade. A second of the two blade segments in the second screw flight located in a direction axially further away from the tapering portion than the first screw flight is formed in a plane substantially parallel to a plane of the at least one main screw blade.

Consequently, a careful inflow of the product or material to be processed is carried out via at least one screw flight. As noted above, in a first screw flight, which lies nearer in the direction of a tapering portion than the other screw flights with the blade segments, the blade segments are oriented so as to be turned forward in relation to the main screw blade. The further blade segments in the next screw flight directly following axially away from the tapering portion are formed or oriented parallel to the main screw blade.

The blade segments are arranged in the conveying path in only two screw flights. In a first of the two screw flights which lies nearer in the direction of a tapering portion than the other of the two screw flights, part of the blade segments are oriented so as to be turned forward in relation to the main screw blade. A further part of the blade segments in the next screw flight directly following axially away from the tapering portion are formed parallel to the main screw blade.

Additionally the tapering region of the screw has arranged in it, in the screw flight, an auxiliary screw blade which extends over the entire tapering region of the screw.

The present disclosure also relates to a damming device arranged in a transitional region between the cylindrical portion and the conical or tapering region.

In accordance with the present disclosure, an output of the centrifuge can be increased by approximately 20%. That is, from 5 t/h to 6 t/h.

The oil yield from the centrifuge, according to the present disclosure, is increased by approximately 10%.

The solid phase can be set, for example, at a residual moisture content of approximately 40% to 55%. It is thereby possible to meet the essential requirements as to a residual moisture content, even as a function of the respective provisions to be adhered to.

By the screw or centrifuge, according to the present disclosure, the two-phase oil extraction, and also the three-phase oil extraction still occasionally used, can be improved. In the latter case, the oil is separated as a liquid phase in a three-phase separating cut from a second phase, essentially from water, and from a third phase, essentially from solids.

According to the present disclosure, by a combination of clearances and of "intermediate blade segments" in the conveying path on only two screw flights, the efficiency of various centrifugal separating processes in three-phase separation can surprisingly be markedly increased further, as compared with the prior art. That is because an acceleration of the solid, both in the circumferential direction and in the axial direction, is achieved. This entails be ter phase separation of the viscoelastic and compressible paste. This prevents the situation where the inflowing paste, immediately after flowing in, is compacted when it impinges onto the solid in the rotor.

In accordance with the present disclosure, the screw can also be retrofitted easily in existing centrifuges.

The screw, according to the present disclosure, is suitable for use in a method for oil extraction from fruits and seeds and for the better dewatering and/or deoiling of mashes including organic materials, for example seed mashes, pod mash, animal tissue, such as fish, protein, and fatty tissue cells. Moreover, the situation is prevented where the inflowing paste, immediately after flowing in, is compacted when it impinges onto the solid in the rotor.

The screw, according to the present disclosure, is also suitable for the dewatering of other compressible pulps. For example, the dewatering is applicable in wine production.

The clearances in the screw blades are designed in such a way that they project radially at least into the region of the solid zone. For example, 70-95%, or 70-100%, of the screw blade height.

The height of the blade segments is approximately 0-30% lower than the screw blade height.

The blade segments are designed as rectangular plates. The plates may be trapezoidal or have rounded elements and/or elements shaped so as to taper or broaden outward from the screw body.

Other aspects of the present disclosure will become apparent from the following descriptions when considered in conjunction with the accompanying drawings.

The present disclosure also includes drawings, further described below.

DETAILED DESCRIPTION

Figure 1:
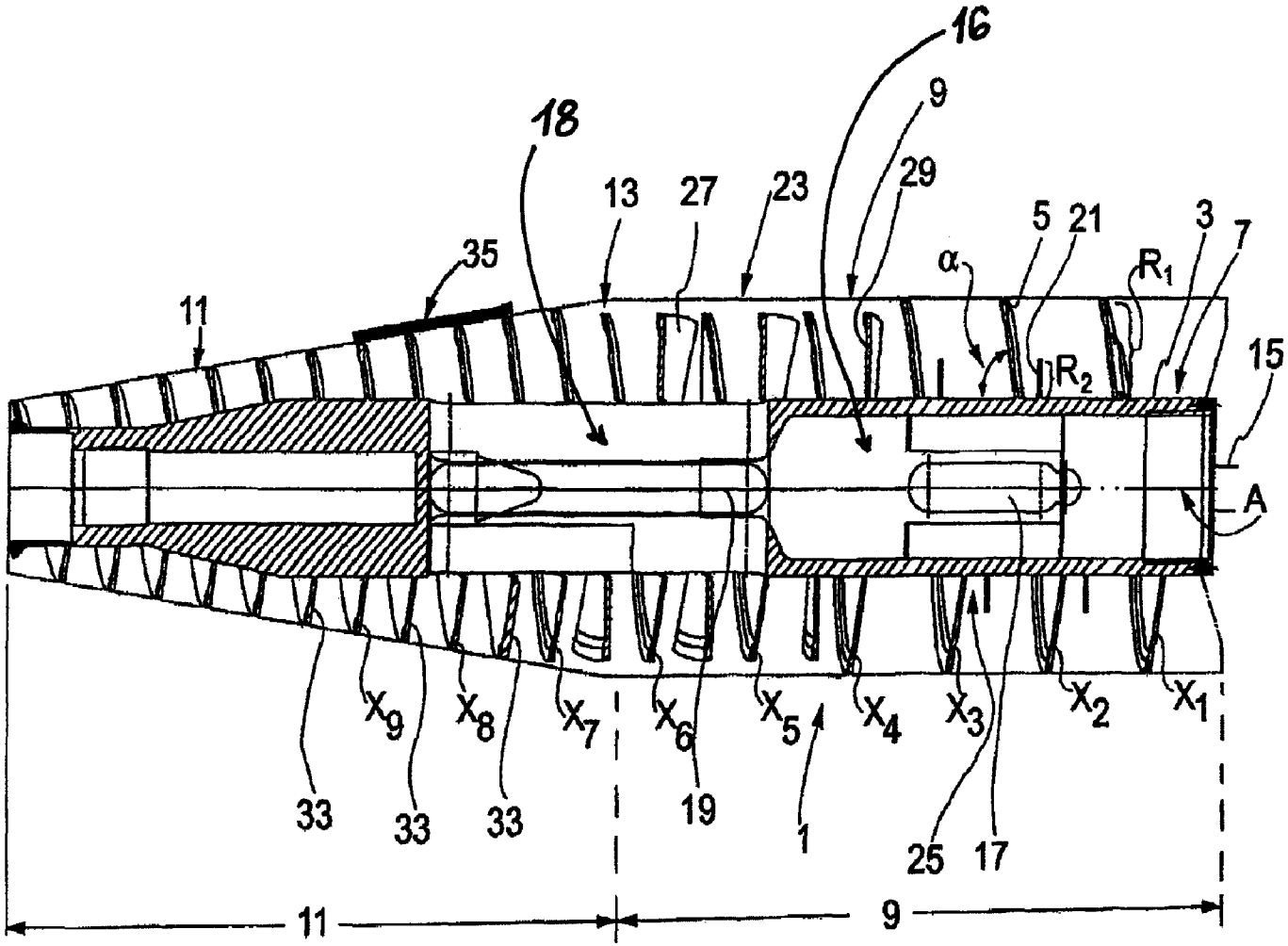
FIG. 1 shows a section through a screw-type solid-bowl centrifuge, according to the present disclosure.
Figure 2:
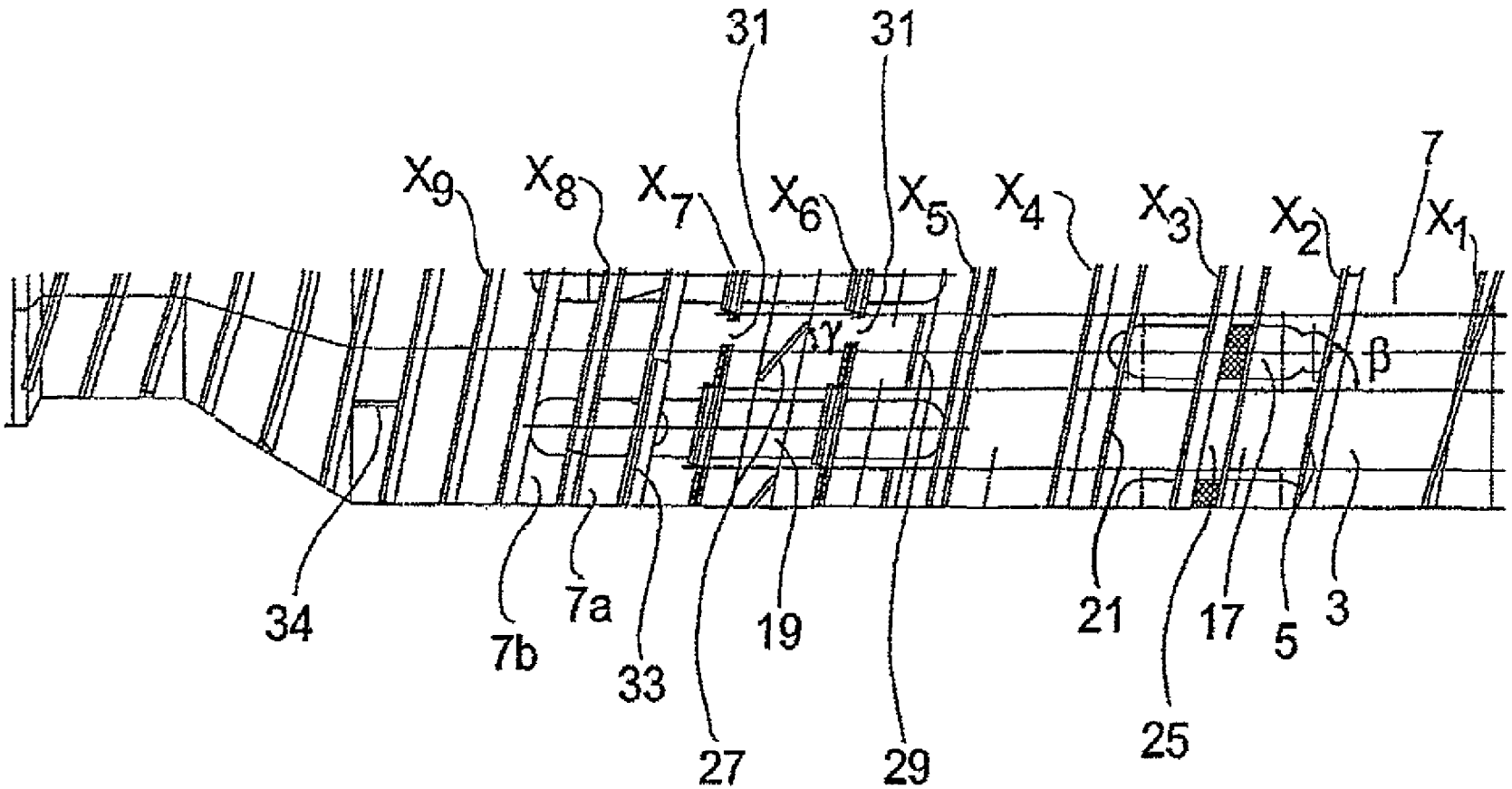
FIG. 2 shows a portion of the centrifuge of FIG. 1.

Terms, such as top or bottom refer to a viewing of FIGS. 1 and 2 and are to be understood as being by way of example.

FIG. 1 shows a screw 1 for a screw-type solid-bowl centrifuge, or it may be referred to as a decanter screw. Screw 1 includes a screw body 3 and a main screw blade 5 which surrounds the screw body 3 and which forms a plurality of screw flights X1, X2, X3, . . . Xn. The main screw blade 5 is inclined at an acute angle $\alpha$ to the surface of the screw body 3 in the direction of a tapering end or portion 11 of the screw 1. That is, in a conveying direction for the solid to be discharged. Angle $\alpha$ is relative to screw axis A or to the screw body 3 in a conical or tapering region, which angle $\alpha$ is smaller than 90°. A pitch of the screw 1 or helix is designated by $\beta$.

A "screw flight" is designated as a screw turn, for example, 360°, of a single-flight screw. According to the present disclosure, screw flights are counted from a liquid discharge area and are designated by X1, X2, X3, . . . , Xn.

The screw flights X1, . . . Xn form a main conveying path 7 for the conveyance/transport of a centrifuging stock or material to be processed.

A drum 35 includes an enveloping curve 23 and has, in a rear region, a cylindrical portion 9 and, in a front region adjoining the cylindrical portion 9, a conically tapering portion 11. The screw blade 5 tapers such that the surrounding enveloping curve 23, the contour of which corresponds virtually to the surrounding drum contour of the drum 35, tapers conically from an axial region 13 toward the tapering portion 11 and the region of a solid discharge (not shown). The screw body 3 also tapers toward the region of the solid discharge.

In a transitional region, located between the cylindrical portion 9 and the conical portion 11, a damming device, such as a damming plate 34, may be arranged, which closes or blocks one or both or more screw flights X1, . . . Xn up to a predetermined radius. Two weir-like damming plates 34, of which only one is shown in FIG. 2, are arranged in two of the screw flights X1, . . . Xn transversely with respect to screw blades 33, for example. Such an arrangement may be simple to implement structurally.

The screw 1 is suitable for two-phase and three-phase separation, depending on an axial length of an exchangeable inflow pipe 15.

The centrifuge or decanter, according to the present disclosure, may be used for two-phase or three-phase separation by a simple conversion, for example, depending on the quality of the oils harvested.

The centrifuge, according to the present disclosure, may be used for two-phase and three-phase separation even if the screw 1 is provided only with the elements disclosed herein. A combined two-phase and three-phase screw is advantageous, since, with it, optimal methods can be employed, depending on requirements and the quality of the product to be processed.

Two distributors 16, 18 are offset axially with respect to one another in a direction of the screw axis A. The distributors 16, 18 include first and second inflow ports 17, 19 which are formed on the screw body 3.

The first distributor 16 lies nearer an end of the cylindrical portion 9 of the drum 35, as shown toward the right in FIGS. 1 and 2. That is, toward the liquid discharge (not shown).

The second distributor 18 is designed in such a way that it extends over and beyond axial region 13 which constitutes a boundary between the conical and the cylindrical portions, 9 and 11, respectively, of the screw 1.

If a shorter inflow pipe 15 is used, which terminates downstream of the first distributor 16, this first distributor 16, including its inflow ports 17 into a centrifuging space or drum interior, is utilized as an inflow for introducing the centrifuging stock into the drum 35. This inflow is suitable for two-phase operation in which, for example, oil is separated from a mixed phase including water and solids.

If, by contrast, a longer inflow pipe 15 is used, which extends axially beyond the end of the second distributor 18, this second distributor 18, including its inflow ports 19, is utilized as an inflow. This inflow is suitable for three-phase operation in which, for example, the oil is separated from a water phase and a solid phase.

In the region of the first distributor 16 having inflow ports 17, over a limited axial region which is greater than or at least equal to an axial length of inflow ports 17, a second or auxiliary screw blade 21 is provided. Screw blade 21, as seen from the screw body 3, has outwardly a shorter radial extent or segment height R2 than the first or main screw blade 5 having a radial extent or segment height R1.

It is important that the auxiliary screw blade 21 has at least a radial height of a lighter oil phase collecting inside during operation. Water and solids collect further outward.

The auxiliary screw blade 21 divides off from the screw 1 or the screw flights X1 . . . Xn into a subflight or auxiliary path 25 which is narrower than a remaining main conveying path 7. The inflow ports 17 for two-phase separation are designed to open only into the main conveying path 7 and to be closed in the region of the auxiliary path or subflight 25.

Oil flowing through can, in a two-phase separation, pass this way through the axial region 13, in which the first inflow ports 17 lie, on a rear side of the helix or screw 1 in relation to the conical region 11. This can be done without the product flowing into the main conveying path 7 disturbing its flow in the direction of the liquid discharge ports (not shown but located on the right in FIG. 1). The product, for example, olive mash, can flow into a remaining region of the main conveying path 7.

Excellent two-phase separation is thus achieved. Even in three-phase separation, a positive influence of this zone or region can be noted.

The good result of two-phase separation is assisted by a measure which also has an advantageous effect on three-phase separation. For example, a further screw blade 33 is provided in the tapering region 11 of the screw 1, which further screw blade 33 extends over the entire tapering region or portion 11 as far as solid discharge ports (not shown) and subdivides the main conveying path 7 into two subflights 7*a*, 7*b* of equal width.

As noted earlier, in three-phase separation, the inflow pipe 15 used for two-phase operation can be exchanged for one which extends as far as the second inflow ports 19.

The main screw blade 5 includes clearances 31 which extend inward in the manner of a window from an outer circumference of the main screw blade 5. This results in a blunt region of the main screw blade 5 remaining on the screw body 3.

Along the screw flights, in X1 . . . Xn in a few, or only in two of the screw flights, for example, X6, X5 flights, blade segments 27, 29 that are not fully continuous are arranged in the screw flights X6, X5 and have a smaller radial extent or segment height than the main screw blade 5. The centrifuging stock should flow in here during three-phase separation.

Blade segments 27, 29 lie between the clearances 31 in such a way that they prevent the formation of an axial flow in this region.

The first blade segments 27 in the screw flight X6 lying nearer to the tapering portion 11 of the drum 35, such as directly upstream of the transition to the conical region 11, are oriented so as to be turned forward in a direction of the tapering portion 11. An angle gamma (γ), with respect to the axis of rotation A, is larger than on the further or second blade segments 29, as shown in FIG. 2.

By contrast, the second blade segments 29 directly in the next screw flight X5, following to the right in FIGS. 1 and 2 toward the liquid discharge (not shown), in a region at or upstream of the inflow ports 19, lie substantially parallel to the main screw blade 5.

The conical region or portion 11 of the drum 35, or of the enveloping curve 23 of the screw 1 with a double screw, commences directly downstream of the region including the clearances 31 in a direction of the solid discharge (not shown).

In a drum space or inflow port 19, the centrifuging stock conducted into the centrifuging space is accelerated to an operational rotational speed. Owing to the action of gravity, the solid particles settle in the shortest possible time on a drum wall.

The screw 1 rotates at a somewhat lower or higher speed than the drum 35 and conveys the centrifuged-out solids toward the conical portion 11 and out of the drum 35. By contrast, the liquid in one phase (of a two-phase separation) or in two phases (of a three-phase separation) flows to a larger drum diameter at the rear end of the drum 35 and, if appropriate, is discharged at different radii there.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A screw-type solid-bowl centrifuge comprising, a rotatable drum including a tapering portion and a cylindrical portion;

a rotatable screw having a screw body;

at least one main screw blade surrounding the screw body and forming a plurality of screw flights, the plurality of screw flights forming a conveying path configured to transport a material to be processed in the centrifuge;

two blade segments being arranged in the conveying path in portions of the plurality of screw flights;

the at least one main screw blade being provided in a region of the blade segments that includes clearances configured to allow a throughflow of the material to be processed to flow between adjacent screw flights of the plurality of screw flights;

the two blade segments being further arranged in only a first and a second of the plurality of screw flights;

wherein a first of the two blade segments in the first screw flight lying nearer the tapering portion than the second screw flight, the first of the two blade segments being configured to be turned forward in relation to the at least one main screw blade; and a second of the two blade segments in the second screw flight located in a direction axially further away from the tapering portion than the first screw flight is formed in a plane substantially parallel to a plane of the at least one main screw blade.

2. The screw-type solid-bowl centrifuge of claim 1, wherein an auxiliary screw blade is arranged in one of the screw flights in the tapering portion of the screw.

3. The screw-type solid-bowl centrifuge of claim 2, wherein the auxiliary screw blade extends over the entire tapering portion of the screw.

4. The screw-type solid-bowl centrifuge of claim 1, wherein the first of the blade segments in the first screw flight lying nearer to a liquid discharge are oriented substantially parallel to the at least one main screw blade.

5. The screw-type solid-bowl centrifuge of claim 1, wherein the clearances extend inward in a manner of a window from an outer circumference of the at least one main screw blade, resulting in a blunt region of the at least one main screw blade remaining on the screw body.

6. The screw-type solid-bowl centrifuge of claim 1, wherein the two blade segments are configured to include a radially lower height than the at least one main screw blade.

7. The screw-type solid-bowl centrifuge of claim 1, wherein the clearances extend only over two of the screw flights.

8. The screw-type solid-bowl centrifuge of claim 1, further comprising a damming device arranged in one of the screw flights in a transitional region located between the cylindrical portion and the tapering portion.

9. The screw-type solid-bowl centrifuge of claim 8, wherein the damming device in the screw flight is formed from one or more damming plates which close the screw flight transversely with respect to screw blades in the screw flight up to a predetermined radius.

10. The screw-type solid-bowl centrifuge of claim 1, further comprising:

two distributors offset axially with respect to one another in a direction of a screw axis and including first and second inflow ports formed on the screw body, the screw including an exchangeable inflow pipe, and one of the first and second inflow ports being configured for two-phase or three-phase separation, depending on an axial length of the exchangeable inflow pipe.

11. The screw-type solid-bowl centrifuge of claim 10, further comprising, an auxiliary screw blade formed in the conveying path in a region of the first distributor over a limited axial region which is one of larger than and at least equal to an axial length of the first inflow ports.

12. The screw-type solid-bowl centrifuge of claim 11, wherein the auxiliary screw blade has a smaller radial segment height than the at least one main screw blade.

13. The screw-type solid-bowl centrifuge of claim 11, wherein the auxiliary screw blade has at least a radial height of a lighter oil phase collecting on an inside of the drum during operation.

14. The screw-type solid-bowl centrifuge of claim 11, wherein the auxiliary screw blade divides off from the conveying path an auxiliary path which is narrower than the conveying path and which lies on a rear side of the at least one main screw blade in relation to the tapering portion.

15. The screw-type solid-bowl centrifuge of claim 10, wherein for a two-phase separation, the first inflow ports of the first distributor are configured to be open only into the conveying path and closed in the region of the auxiliary path.

* * * * *